US008167468B1

(12) United States Patent
Olsson et al.

(10) Patent No.: US 8,167,468 B1
(45) Date of Patent: May 1, 2012

(54) LED LIGHTING FIXTURES WITH ENHANCED HEAT DISSIPATION

(75) Inventors: Mark Steven Olsson, La Jolla, CA (US); John Russell Sanderson, IV, Poway, CA (US); Brian Peter Lakin, San Diego, CA (US); Jon Earl Simmons, Poway, CA (US)

(73) Assignee: DeepSea Power and Light, Inc., San Diego, CA (US)

( * ) Notice: Subject to any disclaimer, the term of this patent is extended or adjusted under 35 U.S.C. 154(b) by 23 days.

(21) Appl. No.: 12/700,170

(22) Filed: Feb. 4, 2010

Related U.S. Application Data

(60) Provisional application No. 61/150,188, filed on Feb. 5, 2009.

(51) Int. Cl.
*F21V 33/00* (2006.01)

(52) U.S. Cl. ..... 362/477; 362/101; 362/267

(58) Field of Classification Search ..... 362/477, 362/96, 101, 267
See application file for complete search history.

(56) References Cited

U.S. PATENT DOCUMENTS

2009/0154164 A1* 6/2009 Hsu et al. ..... 362/267
* cited by examiner

*Primary Examiner* — Laura Tso
(74) *Attorney, Agent, or Firm* — Steven C. Tietsworth

(57) ABSTRACT

An LED lighting fixture includes a metal core printed circuit board (MCPCB) having a rear side and a front side. At least one LED is mounted to the front side of the MCPCB. A transparent window is mounted and sealed to the front side of the MCPCB to enclose the LED. A portion of the MCPCB extends from the transparent window so that it can be in heat exchange contact with water when the window of the lighting fixture is submerged in water.

20 Claims, 15 Drawing Sheets

LED LIGHTING FIXTURES WITH ENHANCED HEAT DISSIPATION

CROSS-REFERENCES TO RELATED APPLICATIONS

This application claims priority off of U.S. Provisional Application Ser. No. 61/150,188 filed Feb. 5, 2009 naming Mark S. Olsson et al. as co-inventors. Said application is assigned to DeepSea Power & Light, Inc.

This application is also related to U.S. patent application Ser. No. 12/036,178 of Mark S. Olsson, et al., filed 22 Feb., 2008 entitled "LED Illumination System and Methods for Fabrication," the entire disclosure of which is hereby incorporated by reference. Said application Ser. No. 12/036,178 is also assigned to DeepSea Power & Light, Inc.

FIELD OF THE INVENTION

The present invention relates to lighting fixtures that utilize LEDs.

BACKGROUND

Semiconductor light emitting diodes LEDs have replaced conventional incandescent, fluorescent and halogen lighting sources in many applications due to their small size, reliability, relatively inexpensive cost, long life and compatibility with other solid state devices. In a conventional LED, an N-type gallium arsenide substrate that is properly doped and joined with a P-type anode will emit light in visible and infrared wavelengths under a forward voltage bias. In general, the brightness of the light given off by an LED is contingent upon the number of photons that are released by the recombination of electrons and carriers inside the LED semiconductor material. The higher the forward voltage bias, the larger the current, and the larger the number photons are emitted. Therefore, the brightness of an LED can be increased by increasing the forward voltage. However due to assorted limitations, including the ability to dissipate heat, conventional LEDs have, until recently, been capable of producing only about six to seven lumens.

In the past few years, advanced High Power LEDs, alternately known as High Brightness LEDs (HB-LEDs), have been developed which demonstrate higher luminosity, lower heat profiles, and smaller footprints enabling the use of multiple LEDs in composite area lighting systems. The Cree X-Lamp XR-E, as an example, can produce 136 lumens of luminous flux at 700 mA, with a forward voltage of 3.5V. Its thermal design provides a ratio between the resistance junction and ambient temperature of as low as 13° C./W at maximum current. It provides a small footprint (4.3×7.0×9 mm). They are also reflow-solderable, using a thermal ramp scheme with a 260° C. maximum, enabling certain applications germane to the present invention. Comparable competitive LED products are only slightly behind in market introduction, such as Seoul's Star LED and Luxeon's "Rebel" High Power LEDs.

High-power LEDs still suffer from problems associated with heat dissipation and inefficient distribution of light for certain applications. While high-power LEDs are significantly more efficient than incandescent systems or gas-filled (halogen or fluorescent) systems, they still dissipate on the order of 50% of their energy in heat. If this heat is not managed, it can induce thermal-runaway conditions within the LED, resulting in its failure. For situations requiring high levels of lighting, this situation is aggravated by the requirement of combining many LEDs in a sophisticated composite light-source structure such as an underwater lighting fixture. Heat management becomes a primary constraint for applications seeking to use the other advantages of LEDs as a source of illumination.

SUMMARY OF THE INVENTION

According to the present invention an LED lighting fixture includes a metal core printed circuit board (MCPCB) having a rear side and a front side. At least one LED is mounted to the front side of the MCPCB. A transparent window is mounted and sealed to the front side of the MCPCB to enclose the LED. A portion of the MCPCB extends from the transparent window so that it can be in heat exchange contact with water of any kind when the lighting fixture is in operation in its intended location above or below the water.

DETAILED DESCRIPTION

In marine applications in particular, the use of LEDs as lighting sources has heretofore had limited success, awaiting improved light-output-per-watt (efficacy) and heat management techniques. LEDs can provide an advantage over traditional illumination sources in the marine underwater environment because LEDs afford better penetration of blue to green-yellow wavelengths of light, in the range from ~450 nm to ~600 nm. Light in these wavelengths may be directly emitted from LEDs as a narrow band of desired chromatic light without the need for filters. The wide angle distribution of light by LEDs may be corrected by use of reflectors or lenses to focus the light into a narrower beam as required.

The power of an LED lighting fixture is limited by its ability to conductively dissipate heat into the local environment. This invention is particularly suited to an installation where an LED lighting fixture is mounted onto the surface of a submerged structure that acts to limit the flow of heat from the fixture into the structure itself. A fiberglass or wooden boat hull, the wall of an aquarium, the bottom or side of a non-metallic tank, or a concrete pond are examples of such structures The present invention utilizes a copper, aluminum, steel, other metal or thermally conductive material core to which is affixed a printed circuit board (PCB) by means of a thermally conductive electrical insulator, the laminate herein generally referred to as metal core printed circuit board (MCPCB). The MCPCB, to which are affixed one or more high power LEDs, is extended past the edge of a waterproof housing seal, being an o-ring or other elastomeric seal, allowing the outer radial areas of the face of the MCPCB to directly contact the water environment in which the lighting fixture is placed. The related driver circuitry may or may not be a part of the MCPCB, as package design, economics, and heat management dictate. This design provides the shortest path from the heat sink of the high power LED to the water environment surrounding the lighting fixture, with the minimum number of thermal boundaries in between. This construction thereby provides means to radiate substantial heat longitudinally in a forward direction, away from the lighting fixture, and into water environment surrounding the lighting fixture. The heat is radiated in a longitudinal direction perpendicular to a lateral direction of the MCPCB and the structure on which the lighting fixture is mounted, such as the hull of a vessel.

Figure 1:
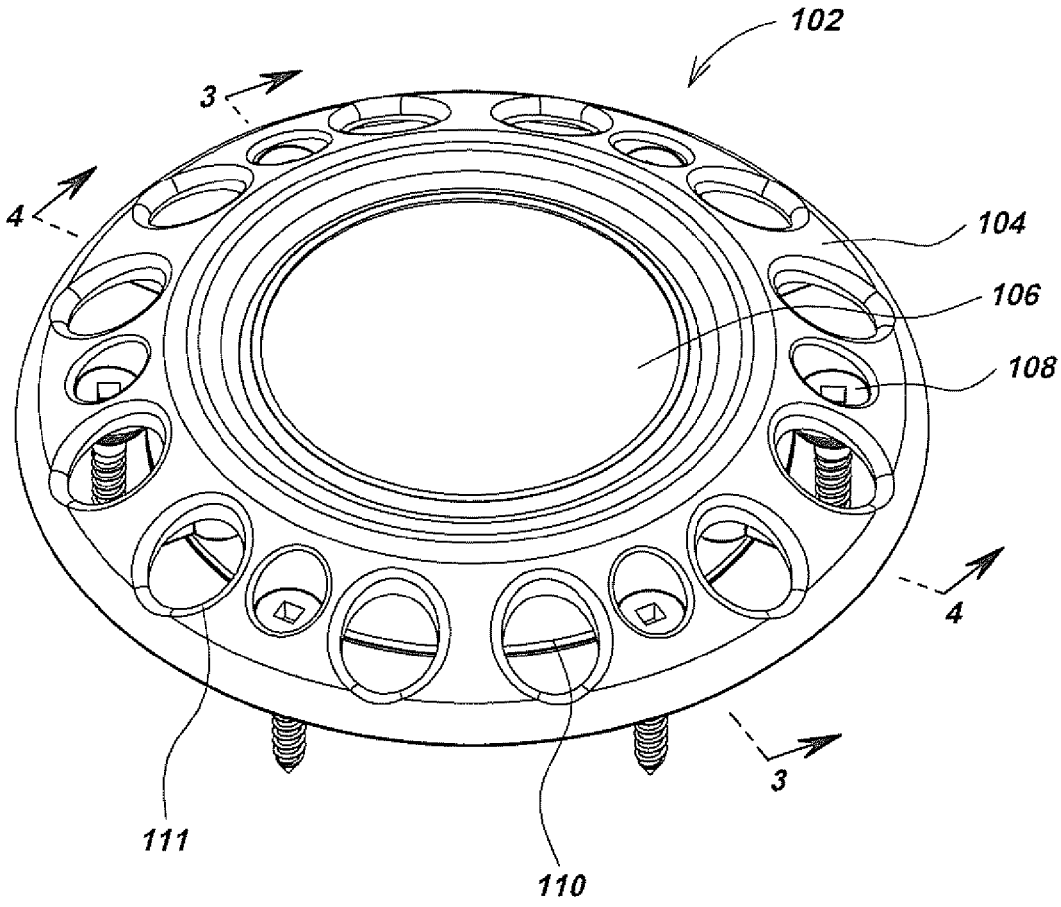
FIG. 1 is an isometric view of the front exterior of an embodiment of the present invention in the form of an underwater On-Hull LED lighting fixture.

FIG. 1 illustrates an embodiment of the present invention in the form of an underwater On-Hull LED lighting fixture 102. A disc-shaped bezel or flange 104 with a tapered outer peripheral wall surrounds and protects a generally cylindrical window housing 106 which is slightingly recessed below the level of the flange 104. The window housing 106 includes a transverse planar window 106*a* and a peripheral cylindrical wall 106*b*, best seen in FIG. 3. An alternate form of this embodiment can utilize a single molded piece that serves the functions of both the flange 104 and window housing 106. In still another form of this embodiment, the window 106*a* can be a flat disc sealed to the periphery of a separate cylindrical wall 106*b*. The flange 104 is made of colored Trogamid plastic to provide an aesthetically pleasing appearance and very high impact strength to deflect foreign object impacts. The window housing 106 is made of a clear Trogamid plastic, providing both optical clarity for the passage of light and a very high impact strength waterproof cover. Six circumferentially spaced screws 108 (FIG. 2) secure the On-Hull lighting fixture 102 directly to a wood or composite vessel hull or other submerged structure (not illustrated). A disc-shaped MCPCB 110 is mounted in a rear portion of the lighting fixture 102. The copper core of the MCPCB 110, which functions as a heat sink, extends radially outward from under the center of the lighting fixture 102 so that it can be directly exposed to the water. In this embodiment, the heat exchange surface of the MCPCB 110 is on the front side of the MCPCB 110. Water passes through holes 111 formed in the flange 104. The holes 111 are equally circumferentially spaced around the tapered outer peripheral wall of flange 104. This relatively cool water flows through the holes 111 and contacts the front side of the MCPCB 110 which acts as a heat exchange surface. This heat exchange action provides the desired thermal management for the LEDs (hereafter described) mounted on the MCPCB and contained within the interior of the lighting fixture 102.

An alternate form of this embodiment utilizes aluminum, steel, or other metal or thermally conductive non-metallic core in the MCPCB in place of the copper core. The non-copper MCPCB may be thinly coated with a thermally conductive barrier to provide improved corrosion protection, such as an aluminum core MCPCB may be anodized, or the steel may be ceramic coated. Copper is the preferred metal core for marine applications because of its anti-biofouling properties and high resistance to saltwater corrosion. A conventional PCB with a very heavy clad copper layer over a glass-epoxy core could be the functional equivalent to a "metal core" PCB. This also allows for a two-sided board with the driver circuitry conveniently placed on the side opposite the LEDs, simplifying assembly.

Figure 2:
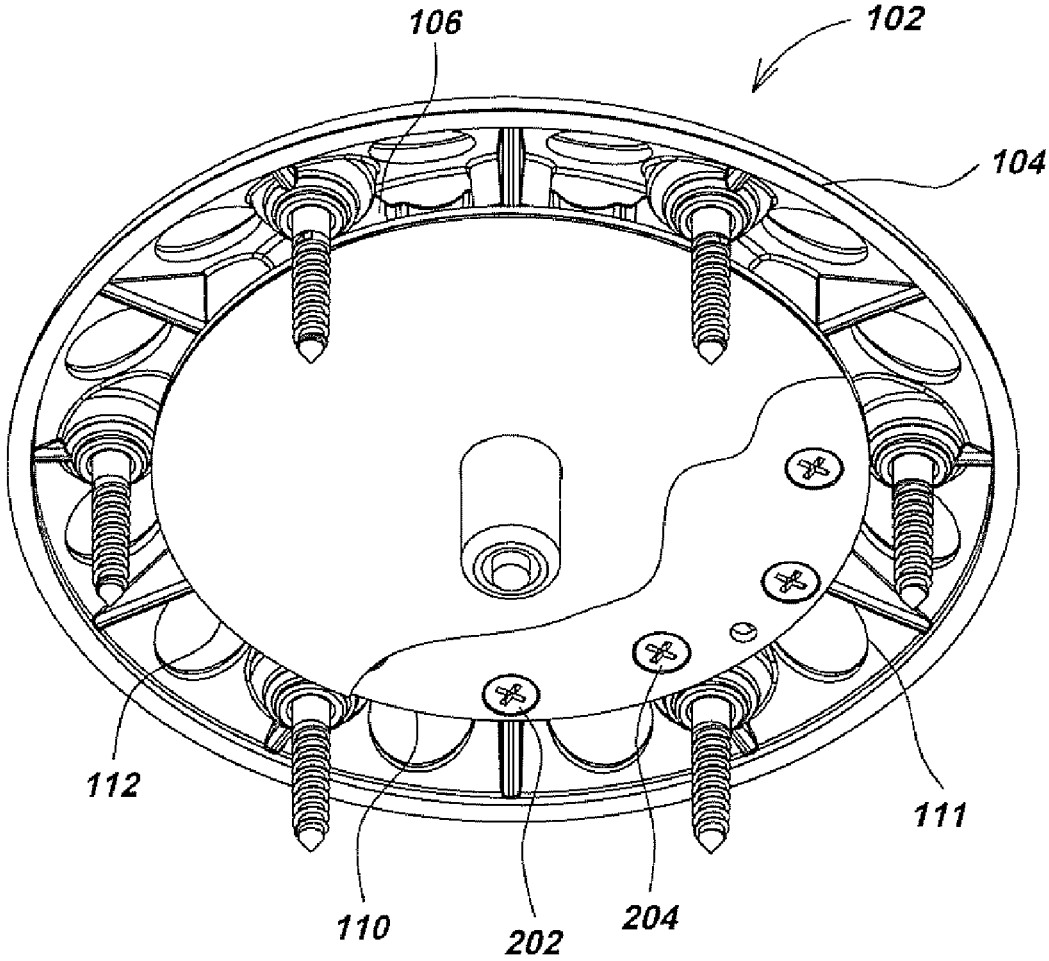
FIG. 2 is an isometric view of the rear exterior of the On-Hull LED lighting fixture of FIG. 1.

Referring to FIG. 2, the MCPCB 110 is centered in the back of the lighting fixture. Six outer bolt screw 202 screws firmly hold the MCPCB 110 engaged with the flange 104. Six inner bolt screws 204 firmly hold the MCPCB 110 engaged with the window housing 106. A self-adhesive plastic backing label 112 adheres to the rear side of the copper core of the MCPCB 110, providing a good bonding surface for the marine grade adhesive. The backing label 112 also inhibits end user tampering with the assembled lighting fixture 102. A marine grade sealant (not illustrated) is spread fully over the back of the lighting fixture 102 to seal the through-hull electrical cable passage (not illustrated) that communicates through the hull into the interior of the vessel. Water passes through holes 111 formed in the flange 104, to contact MCPCB 110.

Figure 3:
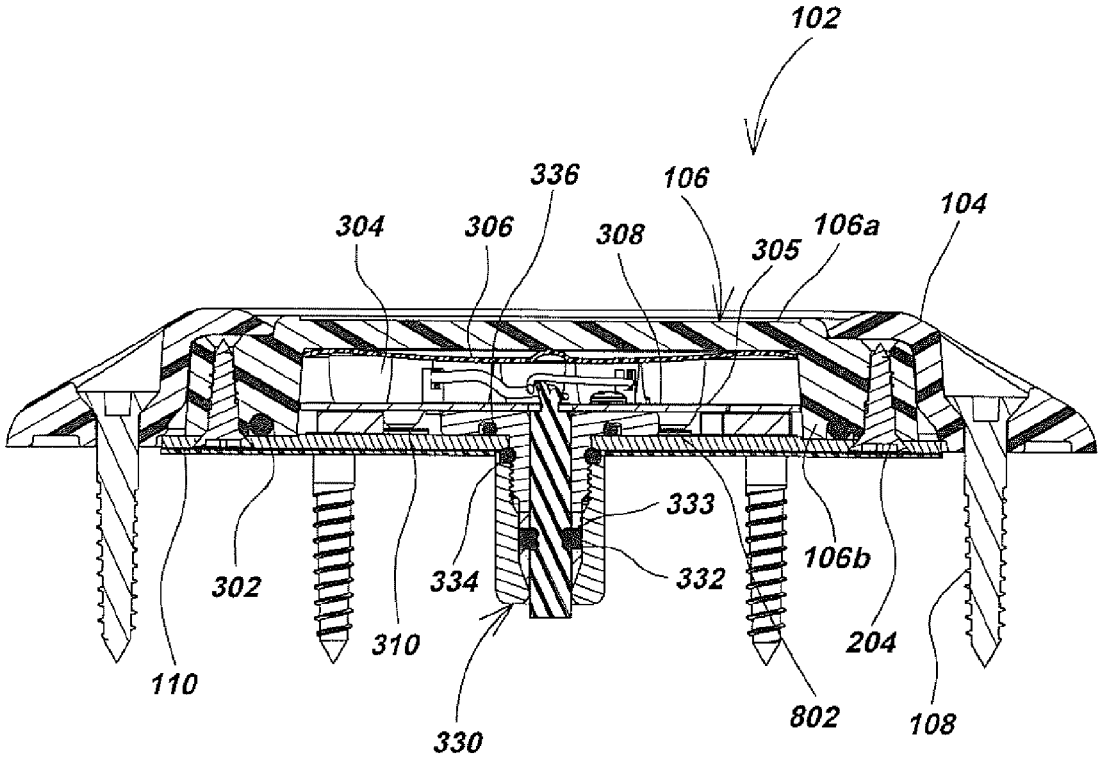
FIG. 3 is a vertical sectional side view of the On-Hull LED lighting fixture taken along line 3-3 of FIG. 1.
Figure 8:
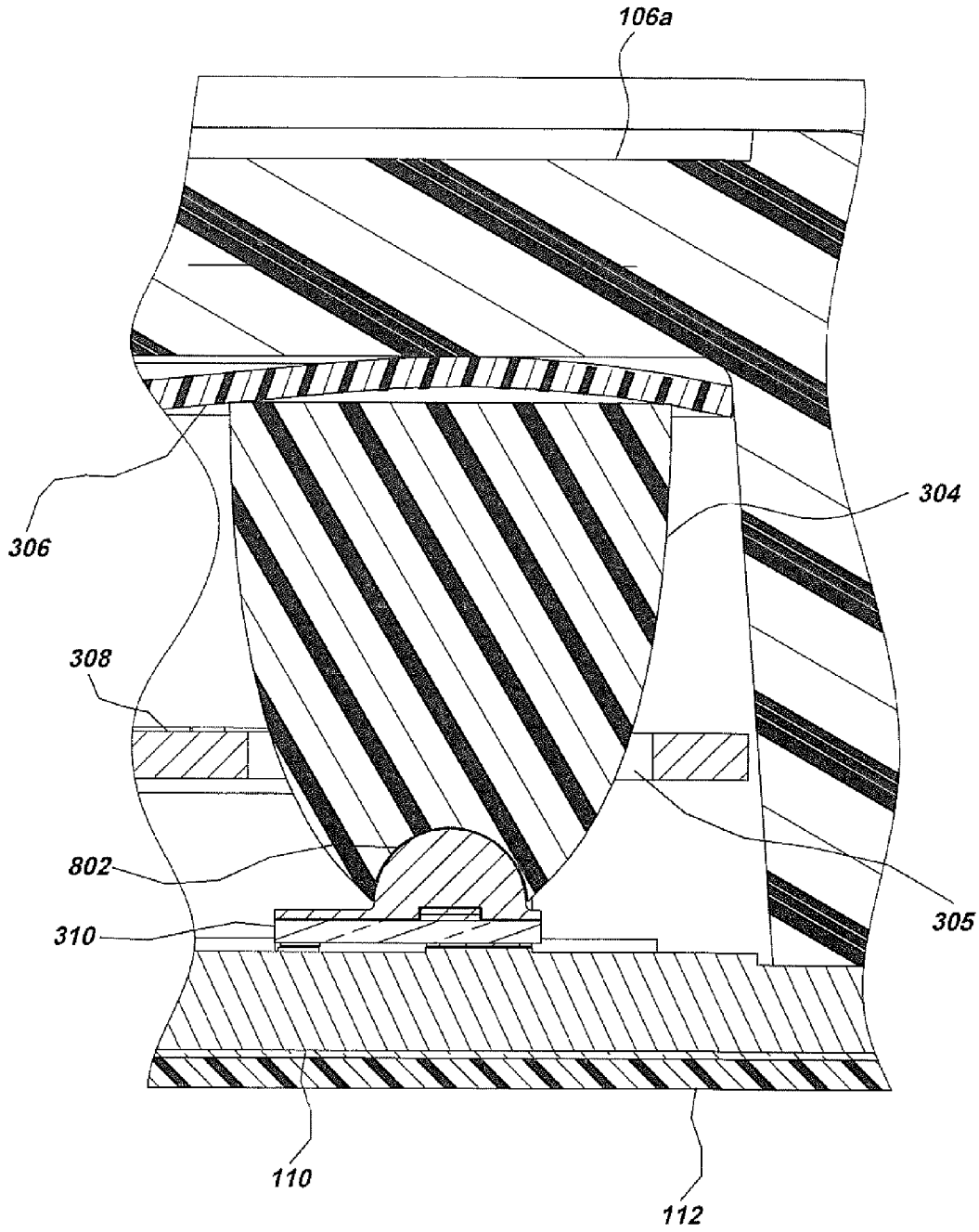
FIG. 8 is an enlarged fragmentary view of a portion of FIG. 3 illustrating the mechanical interaction of the LED, total internal reflection (TIR) lens, and related physical parts.

Referring to FIG. 3, screws 204 firmly hold MCPCB 110 against window housing 106*a*, compressing o-ring 302, making a water tight seal. The o-ring 302 is seated in an annular groove formed in the bottom wall of cylindrical wall 106*b*. A thin, transparent plastic disk 306, leveraging against the inside of the window housing 106, applies a positive spring force to a dozen solid plastic total internal reflection (TIR) lenses 304 holding them stationary within the locating holes 305 in an LED driver circuit board 308, as best seen in FIG. 8. Also best seen in FIG. 8, the twelve TIR lenses 304 have a small hemispherical pocket on the underside that fits the domes of the LEDs 310 that are mounted to the MCPCB 110. A small amount of optical grease 802 optically couples the LED 310 to the TIR lenses 304, reducing optical losses. By way of example, the LEDs 310 may comprise Cree X-Lamp XP-Series LEDs, Seoul Semiconductor Z5 LEDs, Philip Luxeon "Rebel" High Power LEDs, or similar high power LED die fitted in a small package. The MCPCB 110 extends axially above the bottom of the flange 104 to provide a small amount of clamping action as each screw 108 pulls flange 104 into contact with window housing 106, thereby pressing MCPCB 110 hard against the boat hull. A cable seal gland 330 is mounted in rear of the LED lighting fixture 102. A plurality of axially spaced o-ring seals 332, 333, 334 and 336 provide, redundant protection against fluid or gas intrusion to the interior of the boat should the transparent window housing 106 be fractured.

Figure 4:
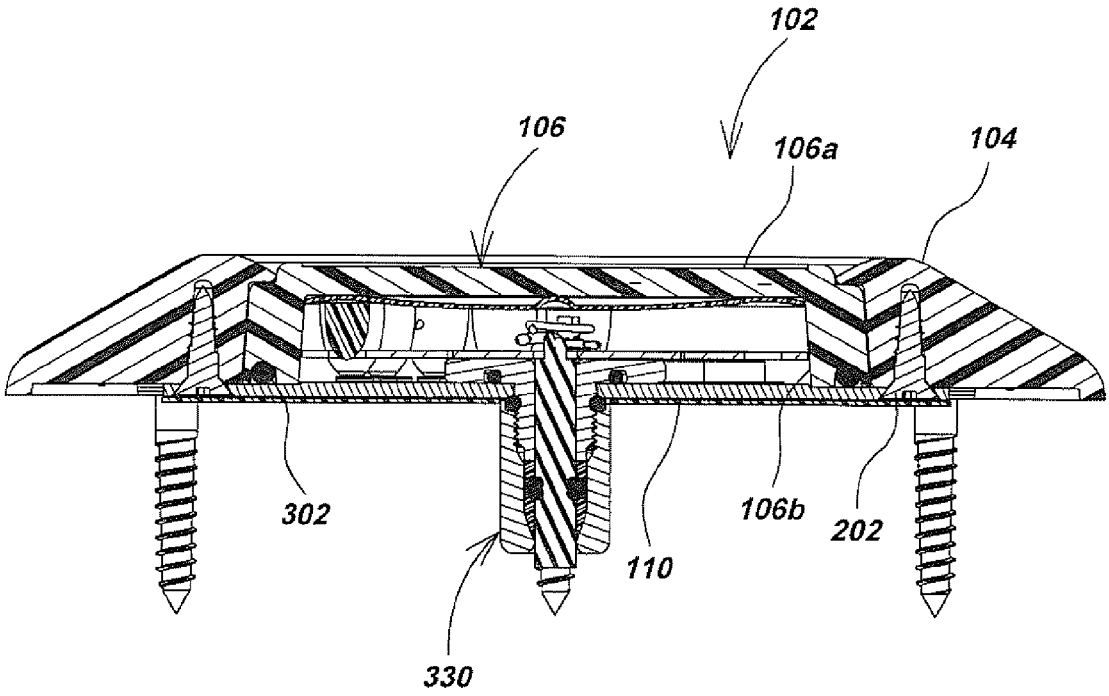
FIG. 4 is a vertical sectional view of the On-Hull LED lighting fixture taken along line 4-4 of FIG. 1.

FIG. 4 illustrates the screws 202 pulling the MCPCB 110 against the flange 104. The flange 104 draws down on the window housing 106, comprised of planar window 106*a* and cylindrical wall 106*b*, pressing it against the MCPCB 110.

This construction provides a second means of compressing the o-ring 302. A cable seal gland 330 is mounted in the rear of the LED lighting fixture 102.

Figure 5:
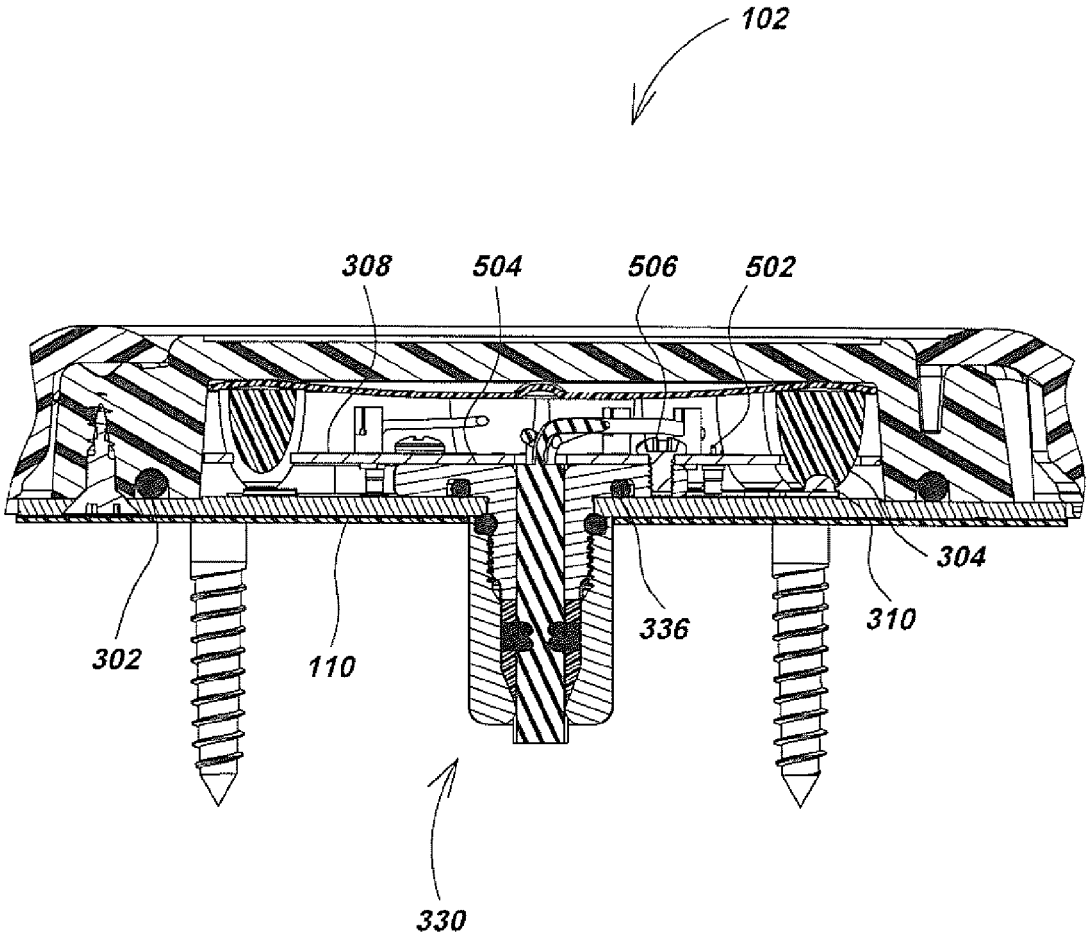
FIG. 5 is an enlarged vertical sectional view similar to FIG. 3 illustrating details of its driver mount and spring contacts.

Referring to FIG. 5, an LED driver circuit board 308 is fastened to a driver mount 504 by a plurality of screws 506. When the driver mount 504 is press fit into the MCPCB 110, o-ring 336 is compressed, forming a watertight seal with the MCPCB 110. Electrical power is delivered to the LEDs 310 on the MCPCB 110 from the LED driver board 308 by means of spring pins or contacts 502. Use of these spring contacts 502 simplifies assembly. The illustrated spring contacts 502 provide for a reliable electrical connection in a high vibration environment such as that found on a boat hull due to engine vibration and wave slap. The LED driver board 308 also functions to position the multiple total internal reflection (TIR) lenses 304 over the corresponding LEDs 310 mounted on the MCPCB 110 below, as best seen in FIG. 8. A cable seal gland 330 is mounted in the rear of the LED lighting fixture 102.

Figure 6:
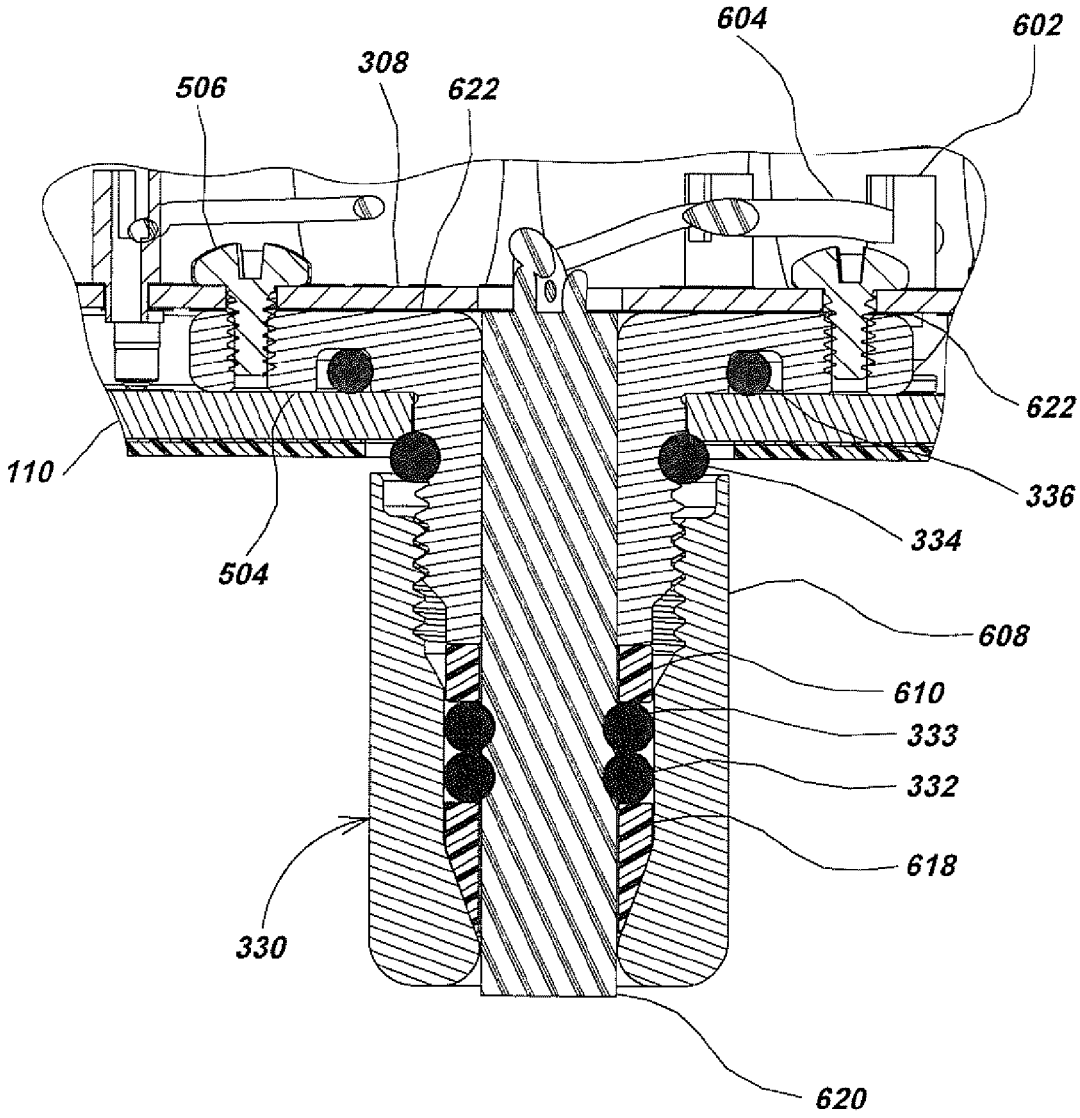
FIG. 6 is an enlarged fragmentary view of a portion of FIG. 3 illustrating the rear cable sealing gland of the On-Hull lighting fixture in its uncompressed state.

Referring to FIG. 6, a rear cable sealing gland assembly 330 is used to provide an electrical connection to the LED driver circuit board 308. In FIG. 6 the rear cable sealing gland assembly 330 is illustrated in an untightened, loose state, where o-rings 332, 333, and 334 are uncompressed. The driver mount 504 is press fit into the MCPCB 110, o-ring 336 is compressed, forming a watertight seal with the MCPCB 110. Referring to FIG. 5, the LED driver board 308 is held to the driver mount 504 by screws 506. The copper cladding used for the printed circuit board traces on the top side of the LED driver board 308 has been chemically removed in the area of each screw 506 to prevent shorting the circuit to the driver mount 504. A plastic Kapton spacer 622 under the LED driver board 308 electrically isolates the underside of the LED driver board 308 from the metal driver mount 504. Jacketed multi-conductor cable 620 passes through the driver mount 504 where wires 604 are separated and routed to solder connections 602. In one form of this embodiment, the jacketed multi-conductor cable 620 contains two wires for power only. In an alternate form of this embodiment, the jacketed multi-conductor cable 620 contains three to four wires in the cable, two for power and one or two for control of dimming, strobing, or color selection options. The interior of a clamp nut 608 contains Teflon washer 610, two seventy-durometer o-rings 332 and 333, and a tapered Teflon gland ring 618. Multiple seals in series provide redundant protection against fluid or gas intrusion to the interior of the boat should the transparent window be otherwise compromised. O-ring 334 is used as a means to prevent rotation of the clamp nut 608, and as a watertight radial seal. Additional sealing for this junction will be made by the hull mounting sealant when installed on a boat.

Figure 7:
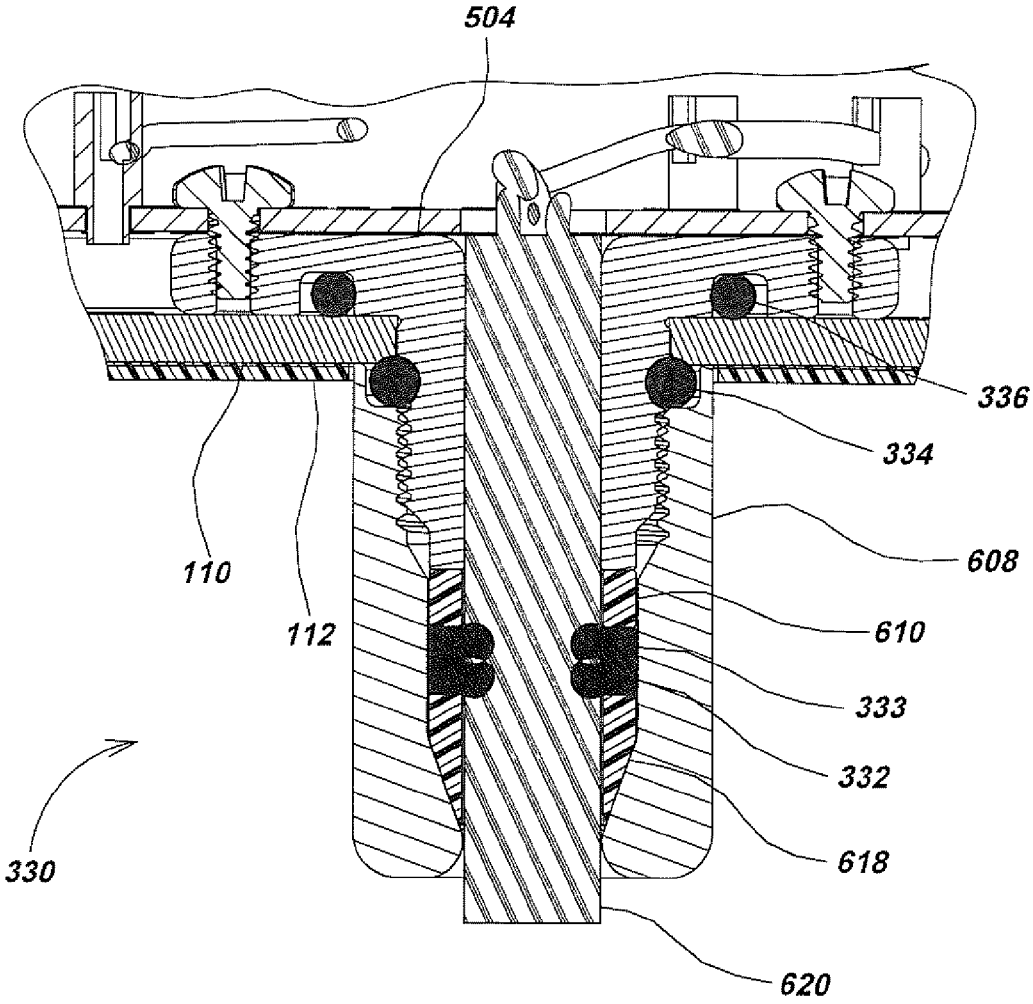
FIG. 7 is a view similar to FIG. 6 illustrating the rear cable sealing gland in its compressed state, ready for installation.

FIG. 7 is a close-up sectional view illustrating the rear cable sealing gland assembly 330 in an assembled, compressed state, ready for installation on a boat hull. In this view, the driver mount 504 has been pressed into the MCPCB 110, compressing the o-ring 336, making a watertight seal. When clamp nut 608 is tightened, Teflon washer 610 engages the two seventy-durometer o-rings 332 and 333, causing them to squeeze and lightly deform the multi-conductor cable 620 jacket, providing a dual watertight compression seal. Additionally, the seventy-durometer o-ring 334 is compressed, making a water tight seal to prevent water from entering the press fit junction The tapered Teflon gland ring 618 is forced to bite into the exterior surface of the multi-conductor cable 620 jacket, providing a mechanical grip to prevent the cable from physically moving inward or outward. The self-adhesive plastic backing label 112 adheres to the copper, providing a good bonding surface for the marine grade adhesive, and restricts end user tampering with the assembly.

FIG. 8, illustrates details of the cooperation of one of the TIR lenses 304 and its associated LED 310. A small amount of optical grease 802 fills the thin gap between the silicone dome of the LED 310 and the matching concave surface on the bottom of the TIR lens 304. Use of this optical grease minimizes boundary reflection, providing maximum lighting throughput at the optical junction. The LED 310 is mechanically and electrically connected to the MCPCB 110 via solder (not illustrated). The TIR lens 304 is centered over the LED 310 by holes 305 in the LED driver board 308. The thin transparent disk 306 functions as a wave spring pressing the TIR lens 304 downward against the LED 310. The disk 306 flexes against the inside of the clear plastic window **106*a*, and presses down on the top of the TIR lenses, thereby assuring positive engagement of the TIR lens with the corresponding LED below it. The self-adhesive plastic backing label 112** adheres to the copper, providing a good bonding surface for the marine grade adhesive, and restricts end user tampering with the assembly.

Figure 9:
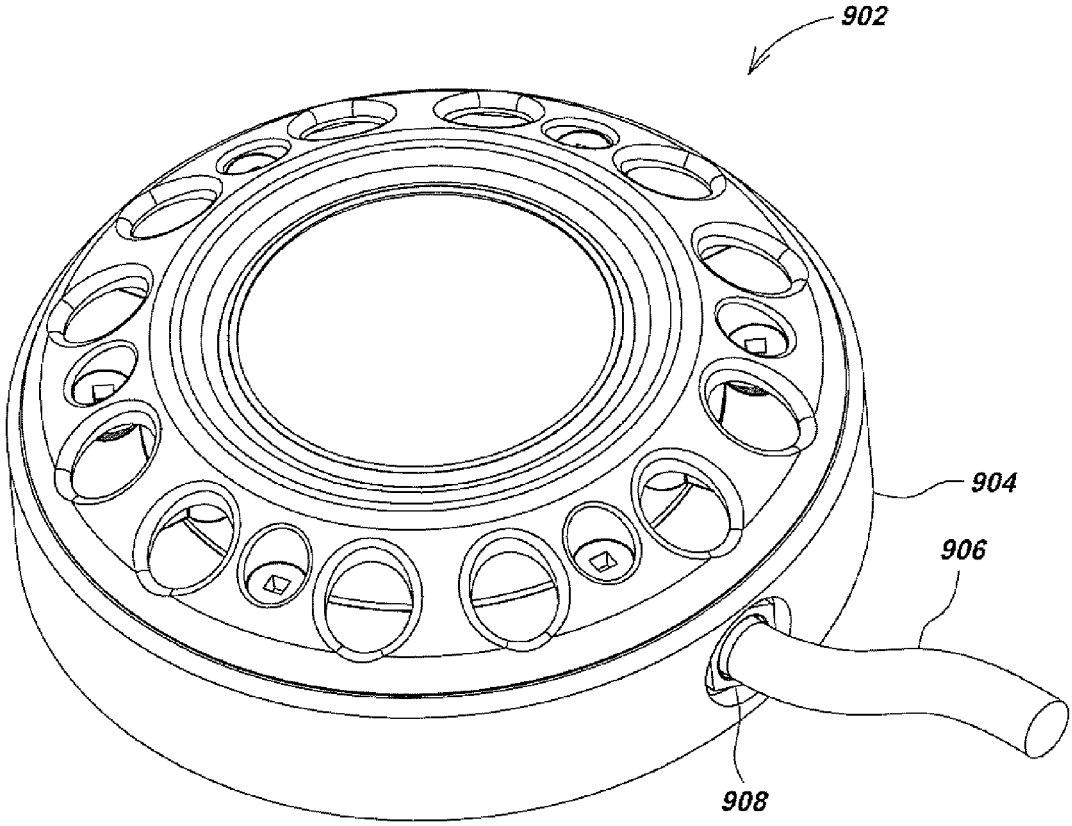
FIG. 9 is an isometric view of the front exterior of an alternate embodiment of the present invention in the form of a lighting fixture suitable for mounting on a dock.

FIG. 9 illustrates another embodiment of the present invention in the form of an underwater LED 902 lighting fixture suitable for mounting on a dock. The principal elements of the LED On-Hull lighting fixture 102 are modified to allow the jacketed multi-conductor cable 906, used for power and control, to come off the lighting fixture 902 at a right angle rather than an angle perpendicular to the back. The jacketed multi-conductor cable 906 contains three to four wires in the cable, two for power and one or two for control of dimming, strobing, or color selection. A base mount 904 provides the substructure needed for low-profile attachment. The cable sealing gland assembly 908 is similar to the cable sealing gland assembly 330.

Figure 10:
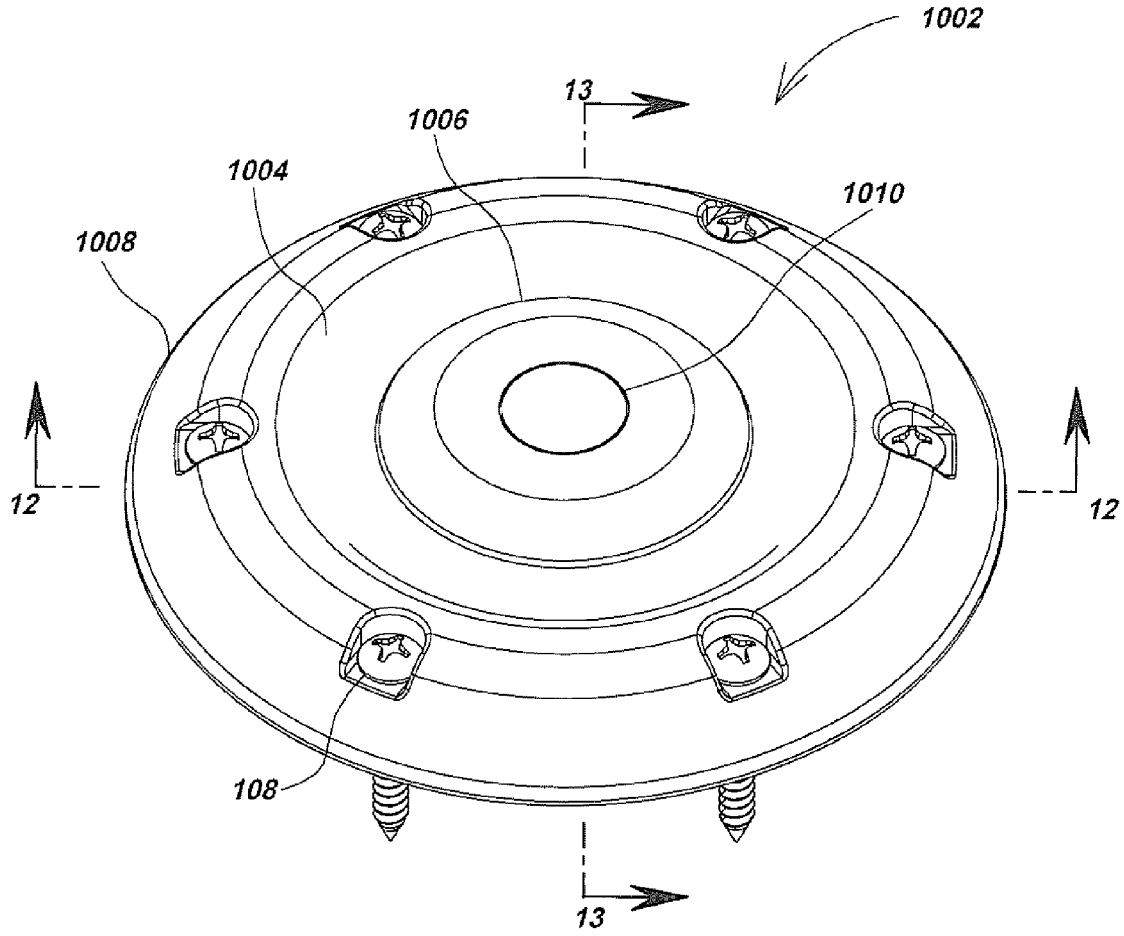
FIG. 10 is an isometric view illustrating the front exterior of an alternate embodiment of the underwater On-Hull LED lighting fixture.

FIG. 10 illustrates another embodiment of the invention in the form of an underwater On-Hull LED lighting fixture 1002 that has even further improvements in heat dissipation. The copper core of a metal core printed circuit board (MCPCB) 1004, which functions as a heat sink, extends radially outward from under the clear LED cover 1006 so that it can be directly exposed to water. A front label 1010 provides for product identification and a means to hide any imperfections from injection molding process. A capture ring 1008 surrounds and protects the metal core printed circuit board (MCPCB) 1004 and other interior parts, and provides a plurality of locations for circumferentially spaced wood screws 108 to secure the light fixture to a composite or wood hull.

The capture ring 1008 is made of colored Trogamid plastic to provide an aesthetically pleasing appearance and very high impact strength to deflect foreign object impacts. The LED cover 1006 is made of a clear Trogamid plastic, providing both optical clarity for the passage of light and a very high impact strength waterproof cover. Water contacts the front side of the MCPCB 1004 thus acting as a heat dissipation surface to provide enhanced thermal management for the LEDs and driver circuit contained within the lighting fixture. An alternate form of this embodiment allows for aluminum, steel, other metal or thermally conductive non-metallic core in the MCPCB. Copper is the preferred metal core for marine applications because of its anti-biofouling properties and high resistance to saltwater corrosion.

Figure 11:
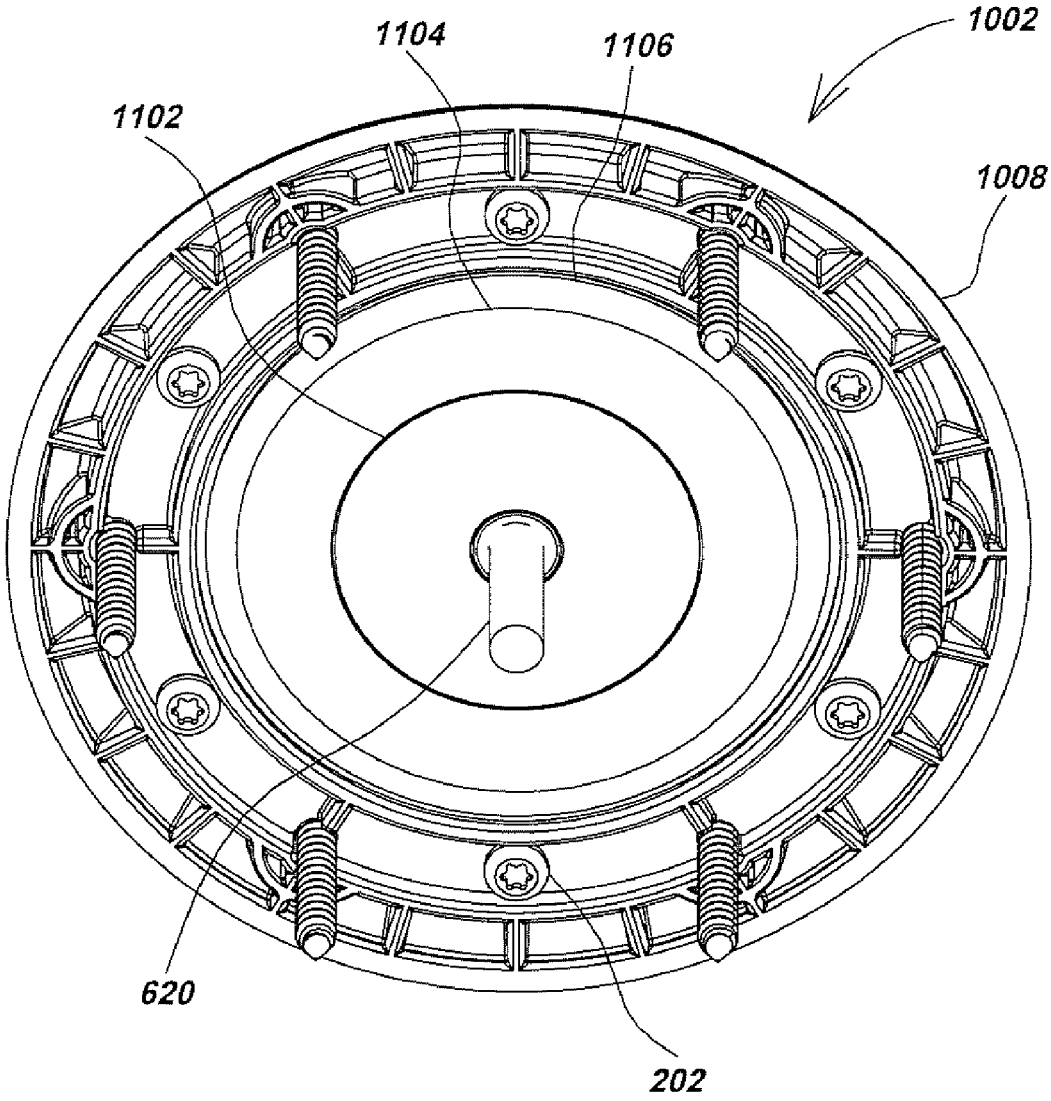
FIG. 11 is an isometric view illustrating the rear exterior of the On-Hull LED lighting fixture of FIG. 10.

Referring to FIG. 11, the fixture base 1104 of the On-Hull lighting fixture 1002 is centered in the back of the capture ring 1008, and retained by six flathead screws 202. The fixture base 1104 is made of colored Trogamid plastic to provide very high impact strength. A self-adhesive plastic backing label 1102 adheres to the plastic base fixture 1104, providing a good bonding surface for the marine grade adhesive if used, and restricts end user tampering with the assembly. An annular groove 1106 formed in the bottom wall provides a means to seal against the hull by use of a 70-durometer o-ring 1210 (FIG. 12) and avoid the use of marine grade adhesives. A jacketed multi-conductor cable 620 passes through the fixture base.

Figure 12:
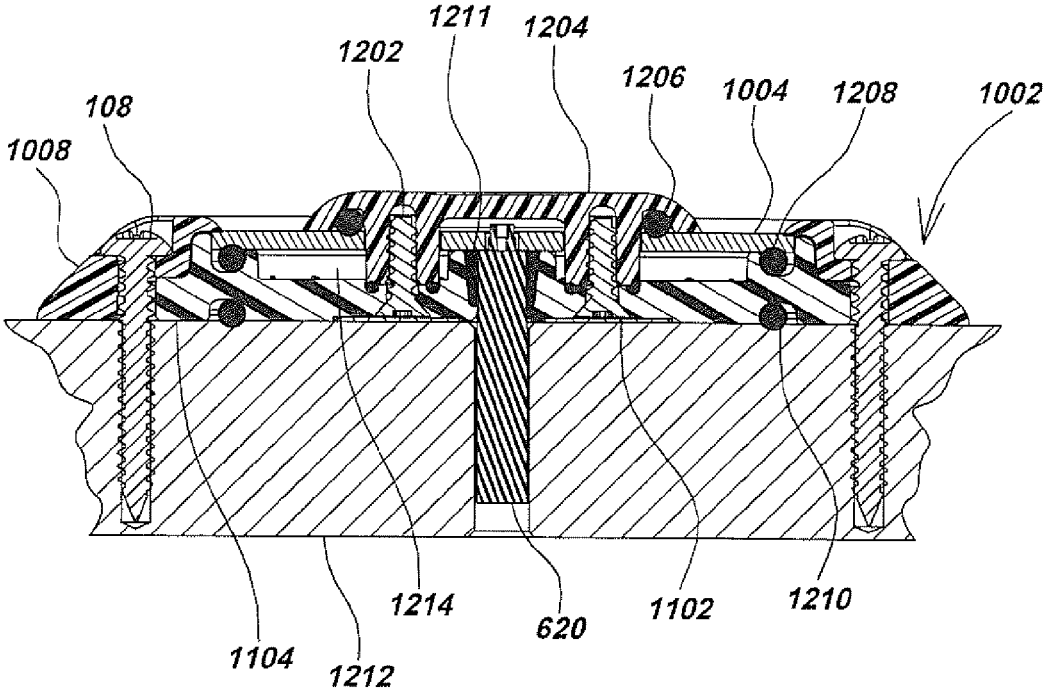
FIG. 12 is a vertical sectional side view of the On-Hull LED lighting fixture of FIG. 10 taken along line 12-12 of FIG. 10.
Figure 13:
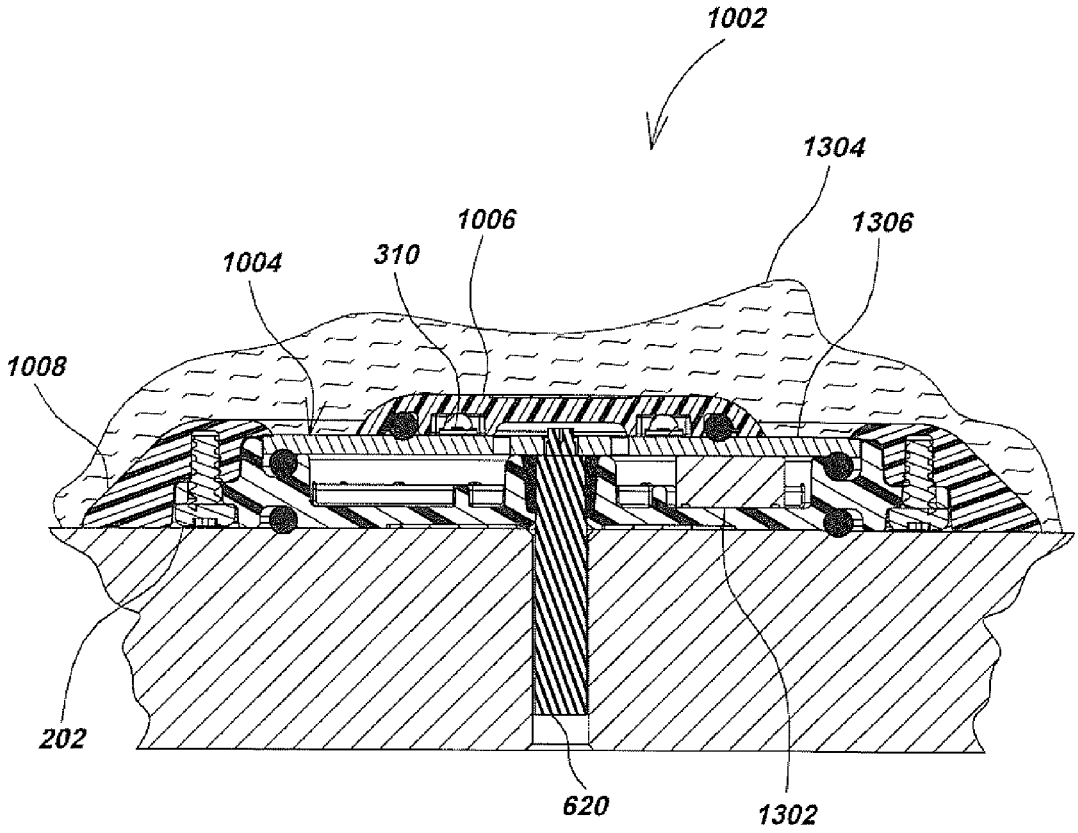
FIG. 13 is a vertical sectional view of the On-Hull LED lighting fixture of FIG. 10 taken along line 13-13 of FIG. 10.

FIG. 12 illustrates the On-Hull lighting fixture 1002 mounted to a wood or composite vessel hull 1212, held in place by screws 108 passing through capture ring 1008. The capture ring 1008 presses down on the base 1104 and provides the force to compress the o-ring 1210. The o-ring 1210 forms a water tight seal with the hull 1212. A jacketed multi-conductor cable 620 passes through a hole in the hull, and into the back of the On-Hull light fixture 1002. A glue seal 1211 bonds the jacket of the cable to the base 1104. Wires connect to a boost-buck LED driver 1302 (FIG. 13). LED cover 1204 clamps to the MCPCB 1004 by tightening flathead screws 1202 which pass through clearance holes in base 1104, and forming a water tight seal by compressing o-ring 1206. The screws 1202 also act to clamp the metal core board 1004 to the base 1104, compressing o-ring 1208, forming a watertight seal. In an alternate form of this embodiment, the volume 1214 may be used to house electronic driver components should a double sided MCPCB or a laminate of two MCPCBs back-to-back be used. A self-adhesive plastic backing label 1102 adheres to the copper, covering the heads of screws 1202 providing a good bonding surface for the marine grade adhesive if used, and restricts end user tampering with the assembly.

FIG. 13 further illustrates the interior construction of the On-Hull underwater light 1002. Marine grade metal screws 202 fix the base 1104 to the capture ring 1008. A boost-buck LED driver 1302 is placed below the MCPCB 1004, where it receives electrical power from cable 620, then delivers power by electrical connection to the LEDs 310 soldered to the front side of the MCPCB 1004. The LEDs 310 radiate light without benefit of reflectors or lenses, relying on the inherent cosine distribution of light from an LED with an over-molded silicone dome, which functions within the air volume inside the clear LED cover 1006. The MCPCB 1004 is illustrated in direct contact with the water environment 1304, in the intermediate region 1306, providing enhanced thermal management for the LEDs and driver circuit contained within the lighting fixture.

Figure 14:
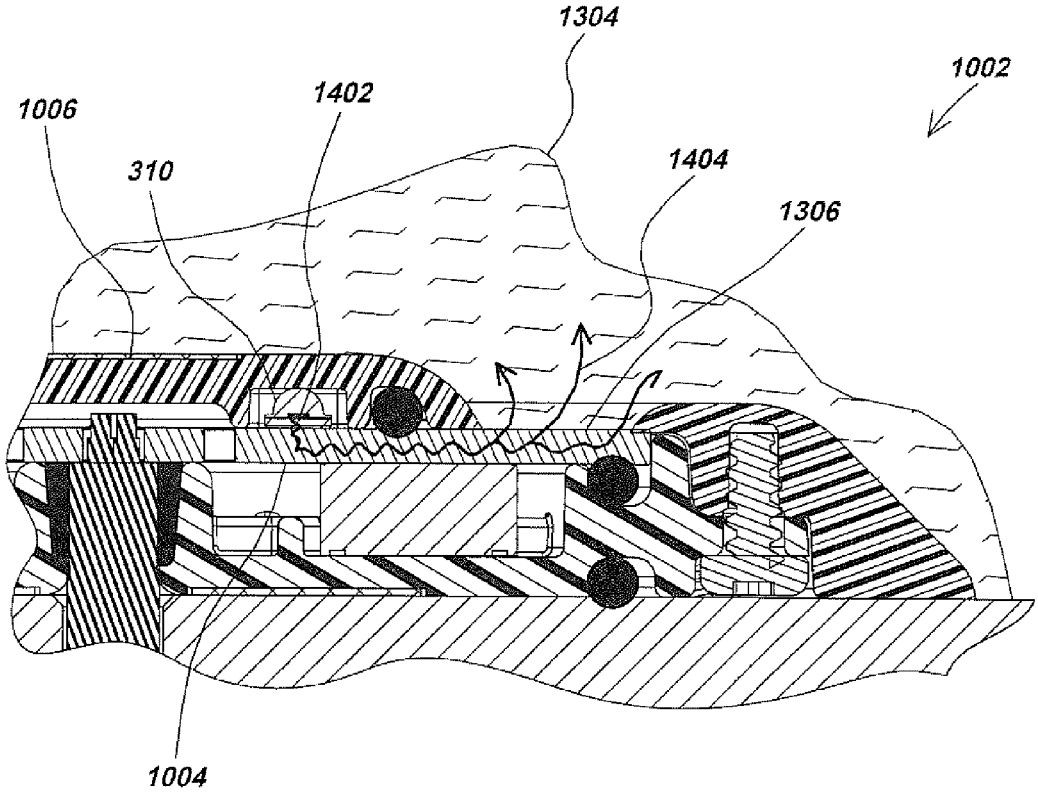
FIG. 14 is an enlarged fragmentary view of a portion of FIG. 13 illustrating further details of the mechanical relationship of the LEDs, MCPCB, cable, seal, housing and environment.
Figure 15:
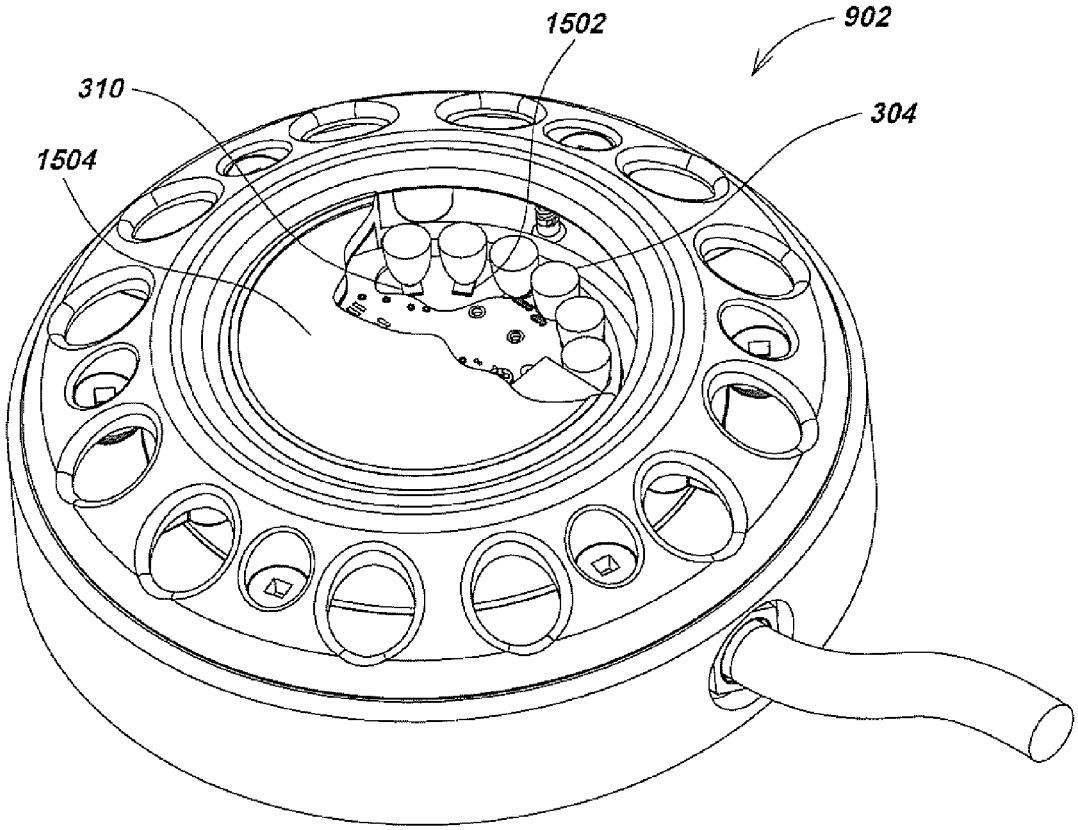
FIG. 15 is an isometric view, with portions broken away, of the front exterior of an alternate embodiment of the present invention in the form of an underwater On-Hull LED lighting fixture incorporating ultraviolet (UV) LEDs.

FIG. 14 illustrates the short path of heat transfer with minimal thermal boundaries in the On-Hull underwater light 1002. Heat 1404 is drawn out the rear of the LED die 1402 inside the LED 310 into the cooler copper MCPCB 1004, where it migrates laterally through the copper towards the region of the MCPCB 1306 in contact with and cooled by the water environment 1304. The use of copper and minimum thermal interfaces maximizes heat 1404 to the surrounding water environment. In the circular configuration illustrated, more area is available at the outer edge for cooling than is at the center under the LED Cover 1006. For example, a one inch diameter plastic LED cover 1006 in the center of a two inch copper MCPCB 1004 provides three times the exposed copper to that under the LED cover. Another alternate embodiment of the invention (not illustrated) can be constructed that places the LEDs 310 near the outer edges of the fixture, so that heat can be transferred to, and radiated from, the central region of the fixture into the water FIG. 15 illustrates the front exterior of another alternate embodiment of the present invention in the form of an underwater LED lighting fixture 902 suitable for mounting on a dock. Here the cutaway illustrates the use of both high brightness white LEDs 310 interspersed with a plurality of UV LEDs 1502, positioned below a plurality of TIR lens 304 in the manner described in FIG. 8. In an underwater or submersible light for the purposes of illumination, adding one or more LEDs that emit light in the UV portion of the electromagnetic (EM) spectrum behind a UV transmitting window 1504 prevents bio-fouling on the outside surface of the window, thereby maintaining the performance of the light by reducing marine growth. Similarly, the UV LEDs 1502 may also be used in On-Hull underwater light fixtures and thru-hull light fixtures, and other underwater illumination applications without restriction. Examples of substantially UV transparent material suitable for the window 1504 include sapphire, borosilicate glass, fused quartz, acrylic, polycarbonate, Styrene, Acrylonitrile Butadiene Styrene (ABS)-Transparent, and amorphous nylon (e.g., Trogamid). The LEDs of the lighting fixture 902 may be operated in various energization modes. In a first mode the UV LEDs are ON all the time at low power, regardless of whether the visible light LED array is ON or OFF. In a second mode the UV LEDs are ON only when the visible light LED array is OFF. In a third mode the UV LEDs are wired opposite to the visible light LED array so that reversing the LED driver output voltage (while limiting current) will forward bias the UV LEDs ON. In an alternate form of the LED lighting fixture 902 all of the UV LEDs are phosphor coated to produce a white light, inherently inhibiting biofouling as a result of the UV peak in the radiated spectra.

While several embodiments of the On-Hull and dock mounted underwater LED lighting fixtures have been described in detail, it will be apparent to those skilled in the art that the present invention can be embodied in various other forms not specifically described herein. These lighting fixtures may be used in above and below water applications, including On-Hull, through-hull, marine, outdoor, landscape, pool, fountain, processing tank, holding tank, fish pen, aquaria, and other underwater or other fluid environments. Lighting fixtures in accordance with the present invention may also be used in interior/exterior terrestrial general, task, and area lighting applications including wall, ceiling, garden, hallway, walkway, tunnels, and various other air or gas filled environments. By way of example, thermal fins may be included on the radiant front surfaces of the LED lighting fixture to enhance the cooling effect by increasing the radiant surface area engaged with the surrounding gas or fluid. An active fluid filled radiator bonded to the surface of the radiant MCPCB surface may alternately be substituted. Therefore the protection afforded the present invention should only be limited in accordance with the following claims.

What is claimed is:

1. An LED lighting fixture, comprising:

a metal core printed circuit board (MCPCB) having a rear side and a front side;

at least one light emitting diode (LED) mounted to the front side of the MCPCB;

a transparent window mounted and sealed to the front side of the MCPCB to enclose the LED; and a portion of the MCPCB extending from the transparent window so that it can be in heat exchange contact with water when the window of the lighting fixture is submerged in water.

2. The lighting fixture of claim 1 wherein the metal core of the MCPCB is made of a metal selected from the group consisting of copper, aluminum and anodized aluminum.

3. The lighting fixture of claim 1 and further comprising a cable sealing gland attached to the rear side of the MCPCB.

4. The lighting fixture of claim 1 wherein the fixture includes a plurality of LEDs, at least one LED emitting light substantially in the visible portion of the electromagnetic (EM) spectrum and at least one LED emitting light substantially in the ultra violet (UV) portion of the EM spectrum to inhibit bio-fouling when the lighting fixture is operating in a submerged environment.

5. The lighting fixture of claim 1 wherein the LED has a phosphor coating that generates light substantially in the visible portion of the EM spectrum with a secondary peak in the UV portion of the EM spectrum to inhibit bio-fouling when the light is operating in a submerged environment.

6. The lighting fixture of claim 1 wherein the MCPCB has a water contact surface that is on the front surface of the MCPCB.

7. The lighting fixture of claim 1 wherein the transparent window is a portion of a window housing that has a disc-shaped planar window and a cylindrical periphery that is engaged by the MCPCB.

8. The lighting fixture of claim 1 and further comprising a generally cylindrical flange that surrounds the window, the flange having a plurality of holes for allowing water to pass there through and contact the heat exchange contact portion of the MCPCB.

9. The lighting fixture of claim 1 and further comprising lens surrounding the LED.

10. The lighting fixture of claim 1 and further comprising a total internal reflection (TIR) lens surrounding the LED.

11. A lighting fixture for providing illumination in a body of water, comprising:

a metal core printed circuit board (MCPCB) having a front side and a rear side;

a plurality of light emitting diodes (LEDs) mounted to the front side of the MCPCB;

a plurality of TIR lenses, each surrounding a corresponding one of the LEDs; and a housing having an interior that encloses the MCPCB, LEDs and lenses, including a transparent window extending across the LEDs and lenses adjacent the front side of the MCPCB, the housing including a portion sealed to the MCPCB, a heat exchange portion of the MCPCB extending outside of the housing for contacting the water so that heat can be drawn out of the LEDs and the MCPCB.

12. The lighting fixture of claim 11 wherein the housing and the lens are integrally formed.

13. The lighting fixture of claim 11 and further comprising a flange surrounding the housing and having a plurality of holes for allowing the water to flow into contact with the heat exchange portion of the MCPCB.

14. The lighting fixture of claim 11 wherein the MCPCB extends in a lateral direction and the LEDs are mounted so that heat flows out of the heat exchange portion of the MCPCB in a longitudinal direction.

15. The lighting fixture of claim 11 wherein a first portion of the LEDs provide illumination substantially in the visible portion of the electromagnetic (EM) spectrum and a second portion of the LEDs provide illumination substantially in the infrared (IR) portion of the EM spectrum.

16. The lighting fixture of claim 11 wherein a surface of the metal core of the heat exchange portion of the MCPCB is exposed for direct contact with the water.

17. The lighting fixture of claim 16 where the exposed surface of the MCPCB is on the upper side of the MCPCB.

18. The lighting fixture of claim 11 wherein the heat exchange portion of the MCPCB is located in a peripheral part of the MCPCB.

19. The lighting fixture of claim 11 wherein the heat exchange portion is located in an intermediate part of the MCPBC between a peripheral part of the MCPCB and a central part of the MCPCB.

20. A lighting fixture for providing illumination in a body of water, comprising:

a laterally extending disc-shaped metal core printed circuit board (MCPCB) having a front side and a rear side;

a plurality of light emitting diodes (LEDs) mounted to the front side of the MCPCB;

a plurality of TIR lenses, each surrounding a corresponding one of the LEDs;

a generally cylindrical housing having an interior that encloses the MCPCB, LEDs and lenses, including a transparent window extending across the LEDs and lenses adjacent the front side of the MCPCB, the housing including a portion sealed to the MCPCB, a heat exchange portion of the MCPCB extending outside of the housing including an exposed front heat exchange surface for contacting the water so that heat can be drawn out of the LEDs and longitudinally through the MCPCB into the water;

a disc-shaped flange surrounding the housing and having a plurality of circumferentially spaced holes for allowing the water to flow into contact with the exposed front heat exchange surface of the MCPCB; and a cable sealing gland attached to the MCPCB.

* * * * *